US005842516A

United States Patent [19]

Jones

[11] Patent Number: 5,842,516

[45] Date of Patent: Dec. 1, 1998

[54] EROSION-RESISTANT INSERTS FOR FLUID OUTLETS IN A WELL TOOL AND METHOD FOR INSTALLING SAME

[75] Inventor: Lloyd G. Jones, Dallas, Tex.

[73] Assignee: Mobil Oil Corporation, Fairfax, Va.

[21] Appl. No.: 825,987

[22] Filed: Apr. 4, 1997

[51] Int. Cl.[6] ..... E03B 3/18; E21B 43/04

[52] U.S. Cl. ..... 166/56; 166/222; 166/51

[58] Field of Search ..... 166/51, 56, 157, 166/158, 222, 223, 233

[56] References Cited

U.S. PATENT DOCUMENTS

| | | | |
|---|---|---|---|
| 3,850,241 | 11/1974 | Hutchinson | 166/222 |
| 4,945,991 | 8/1990 | Jones | 166/278 |
| 5,082,052 | 1/1992 | Jones et al. | 166/51 |
| 5,113,935 | 5/1992 | Jones et al. | 166/51 |
| 5,161,613 | 11/1992 | Jones | 166/242.3 |
| 5,161,618 | 11/1992 | Jones et al. | 166/308 |
| 5,419,394 | 5/1995 | Jones | 166/233 X |

FOREIGN PATENT DOCUMENTS

| | | | |
|---|---|---|---|
| 40534 | 8/1887 | Germany | 166/56 |
| 901422 | 1/1982 | U.S.S.R. | 166/56 |

*Primary Examiner*—David J. Bagnell
*Attorney, Agent, or Firm*—Malcolm D. Keen

[57] ABSTRACT

A well tool having at least one alternate flowpath for delivering fluid to different levels in a wellbore wherein the flowpath is comprised of a conduit having a plurality of outlets spaced along its length which, in turn, are provided with inserts of erosion-resistant material to alleviate erosion of the outlets.

11 Claims, 2 Drawing Sheets

EROSION-RESISTANT INSERTS FOR FLUID OUTLETS IN A WELL TOOL AND METHOD FOR INSTALLING SAME

1. TECHNICAL FIELD

The present invention relates to providing hardened inserts for fluid outlets in a well tool and in one aspect relates to (a) a well tool having at least one shunt tube for delivering fluid to different levels within a wellbore wherein the fluid outlets in said shunt tube are provided with erosion-resistant inserts and (b) a method for installing said inserts in said outlets.

2. BACKGROUND ART

Recently, a series of well tools have been proposed for simultaneously delivering fluids (e.g. fracturing fluids, gravel slurries, treating fluids, etc.) through alternate flowpaths to a plurality of different levels in a wellbore to carry out a particular well operation. For example, a well tool has been proposed for producing multiple fractures in a single operation within a wellbore. This tool is carried on the lower end of a workstring and has a plurality of exit ports or openings which are spaced to lie adjacent the respective zones of the wellbore which are to be fractured when the tool is in its operable position within the wellbore. For a further description of such a tool and its operation, see U.S. Pat. No. 5,161,618. Also, for an example of a similar well tool capable of simultaneously delivering a treating fluid to different levels in a wellbore, see U.S. Pat. No. 5,161,613.

Another well tool of this general type is one which delivers a gravel slurry to spaced intervals around a well screen during a gravel-pack completion operation. This tool is comprised of one or more conduits or "shunt tubes" which extend longitudinally along the well screen. Each shunt tube has a plurality of exit ports or openings which are spaced along its length to simultaneously deliver a gravel slurry to a plurality of different levels within the annulus which surrounds the screen. This provides a good distribution of the gravel across the entire annulus even if "sand bridges" occur in the annulus before the gravel placement is completed. For details of such a well tool and a further explanation of its operation, see U.S. Pat. Nos. 4,945,991; 5,082,052; and 5,113,935.

In well tools of this type, the exit ports or openings in the shunt tubes are very small (e.g. ⅛ inch in diameter). While these small openings have worked quite well in most field applications, it has been found that due to the thin wall of the shunt tubes, the openings have a tendency to erode as fluid passes through the openings under high pressure. This is especially true where the fluid, e.g. slurry, is laden with particulate material, e.g. sand and/or gravel or the like as is the case in most fracturing and/or gravel packing operations.

As certain openings erode and enlarge—usually those near the upper end of a shunt tube—, more and more of the fluid (e.g. slurry) will exit through the enlarged openings with less and less of the fluid exiting through the lower, smaller openings in the shunt tube. This increased flow through the larger, eroded openings can cause "sand bridges" (i.e. accumulation of particulates) to form in the shunt tube, itself, which will block any further substantial downward flow in the tube. Once this occurs, no further fluid can be delivered through the shunt tube to the lower levels of the wellbore and the advantages of using shunts in these types of well operations are lost.

Therefore, it is desirable to provide fluid outlets in the shunt tubes of well tools having alternate flowpaths which will not readily erode but will maintain substantially their original diameter during a complete well operation.

SUMMARY OF THE INVENTION

The present invention provides a well tool for use in a well which is comprised of a body having at least one alternate flowpath extending along said body (e.g. a well screen) for delivering fluid (e.g. gravel slurry) to different levels in a wellbore when said tool is in an operable position within the well. The alternate flowpath(s) is comprised of a conduit having a plurality of spaced outlet openings through which the fluid is delivered to the different levels within the wellbore. The present invention provides an insert means in each the spaced outlet openings to alleviate erosion of these openings as fluid passes therethrough and a method for installing these inserts.

The insert means is comprised of a plate having a recess which is formed only partially through the plate. The recess is adapted to receive an insert which is formed from a erosion-resistant material, e.g. tungsten carbide. An outlet passage is also formed in the plate which is in fluid communication with said recess. The insert of erosion-resistant material, e.g. tungsten carbide, is positioned within the recess and has a passage therethrough which aligns with said outlet passage in the plate when the insert is in the recess. The dimension(s) of the inner perimeter of the recess (e.g. diameter of a circular recess) is only slightly greater that the dimension(s) of the outer surface of the insert (e.g. diameter of a cylindrical insert) so that said insert can be pressed and/or sweated in the recess and readily retained therein.

An opening is formed in the alternate flowpath conduit at each location where an outlet is desired. The insert has a length sufficient to extend from the recess in the plate into a respective opening in the conduit where it may terminate flush with the inside wall of the conduit or may extend into the conduit. With the extension of the insert positioned within its respective opening, the plate is secured to the conduit thereby affixing the insert in the outlet opening.

In a further embodiment of the present invention, the recess and the outlet passage in the plate are formed at an angle so that when the insert is positioned within the recess and the plate is secured to the conduit, the insert will provide a downwardly inclined outlet passage from the conduit.

BRIEF DESCRIPTION OF THE DRAWINGS

The actual construction, operation, and the advantages of the present invention will be better understood by referring to the drawings which are not to scale and in which like numerals identify like parts and in which.

BEST KNOWN MODE FOR CARRYING OUT THE INVENTION

Figure 1:
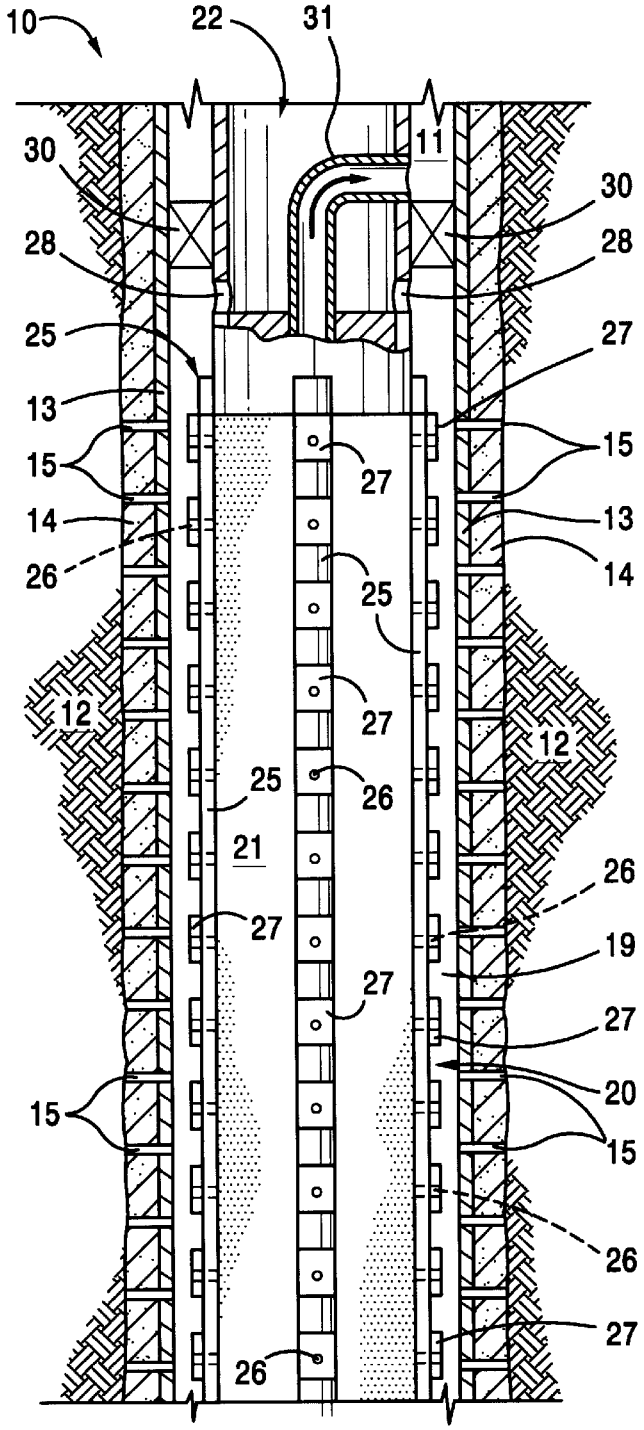
FIG. 1 is an elevational view, partly in section, of a well tool having alternate flowpaths (i.e. shunt tubes) which have outlets in accordance with the present invention.
Figure 2:
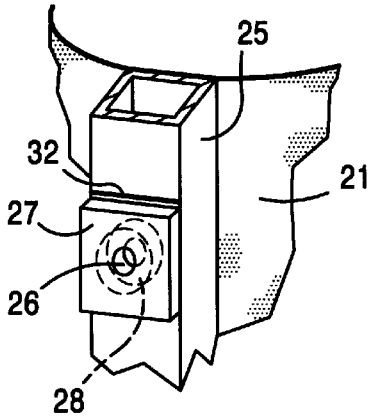
FIG. 2 is an enlarged perspective view of a portion of a shunt tube on the well tool of FIG. 1.

Referring more particularly to the drawings, FIG. 1 illustrates the lower end of a well 10 which is to be "gravel-packed". While the present invention will be described in relation to a well tool 20 having a body comprised of a well screen of the type used in gravel-pack completions, it should be recognized that the present invention is equally applicable to all well tools (e.g. fracturing toolstrings, etc.) which use alternate flowpaths (e.g. shunt tubes).

Again referring to FIG. 1, well 10 has a wellbore 11 which extends from the surface (not shown) through a subterranean formation 12. As shown, wellbore 11 is cased with casing 13 and cement 14 which, in turn, have perforations 15 therethrough to establish fluid communication between formation 12 and the interior of casing 13, as will be well understood in the art. Well tool 20 is positioned within wellbore 11 adjacent formation 12 with annulus 19 being formed between tool 20 and casing 13. As illustrated, tool 20 is comprised of a body, e.g. sand screen 21, and a "cross-over" sub 22 connected to the upper end thereof which, in turn, is suspended from the surface on a workstring (not shown).

Again, it should be recognized that the present invention is not intended to be restricted to any particular type of well screen. Accordingly, the term "screen", as used throughout, is intended to cover all types of similar downhole structures commonly used in gravel pack completions; e.g. commerically-available screens, slotted or perforated pipes, prepacked screens or liners, or combination thereof.

In a typical gravel pack completion, tool 20 is lowered in wellbore 11 and well screen 21 is positioned adjacent formation 12. Packer 30 is set and gravel slurry is pumped down the workstring and out openings 28 in cross-over sub 22. The slurry flows downward in annulus 19 to deposit gravel around screen 21 and form a permeable mass which allows fluid to pass into the screen while blocking the flow of particulates.

As shown, tool 20 is an "alternate flowpath" screen in that it includes at least one shunt tube 25 (e.g. four tubes) thereon. Each shunt 25 is comprised of a conduit having a plurality of outlets 26 spaced along its length. As is known, the purpose of each shunt tube is to deliver fluid, e.g. slurry, to different levels within annulus 19 in the event a sand bridge or the like forms in the annulus before the annulus has been completely gravel packed. For a further description of gravel pack screen having alternate flowpaths and how such screen are installed, see U.S. Pat. No. 4,945,991, issued Aug. 7, 1990, and which is incorporated herein by reference.

In well tools having alternate flowpaths such as that described above, the shunt tubes are typically formed from thin-walled (1/16 inch thick wall), steel conduit in order to keep the outer effective diameter of tool 20 small enough to allow the tool to be readily lowered into casing 13. While the conduit forming shunt tube 25 has been illustrated as having a rectangular cross-section, it should be recognized that conduits having other cross-sections (e.g. circular, etc.) can be used without departing from the present invention.

Due to the small wall thickness of the shunt tubes 25, outlet openings 26 have a tendency to erode as fluid under pressure exits therethrough. This is especially true where the fluid is a particulate-laden, gravel slurry such as that used in gravel-packing a well.

Typically, the outlet(s) 26 at or near the upper end of a shunt tube will erode more quickly than the lower outlets which results in the majority of the fluid in the shunt tube flowing through the enlarged outlets. As flow is increased through the eroded outlets, particulates from the slurry have a tendency to accumulate within the shunt tube adjacent the enlarged outlets and form a sand bridge or the like which, in turn, blocks further flow through the shunt tube. When this occurs, fluid can no longer be distributed through the shunt tube to the different levels within the annulus surrounding the screen and the shunt tube loses its effectiveness.

Figure 3:
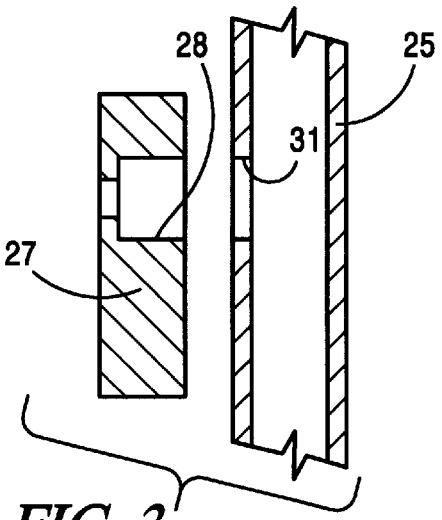
FIG. 3 is a further enlarged, partial sectional view of the shunt tube of FIG. 2 as it might appear during the first step of installing a hardened insert within an outlet opening thereof in accordance with the present invention.
Figure 4:
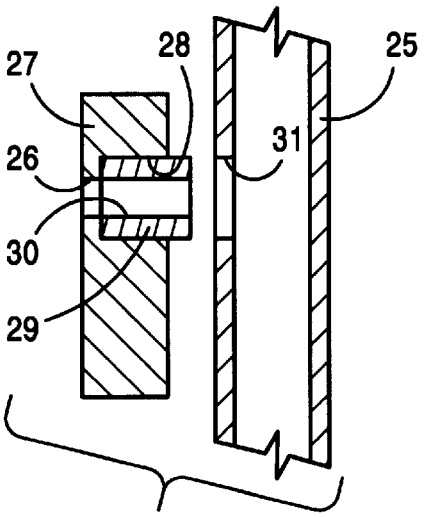
FIG. 4 is a sectional view, similar to FIG. 3, illustrating a further step of installing an insert into an outlet of a shunt tube.
Figure 5:
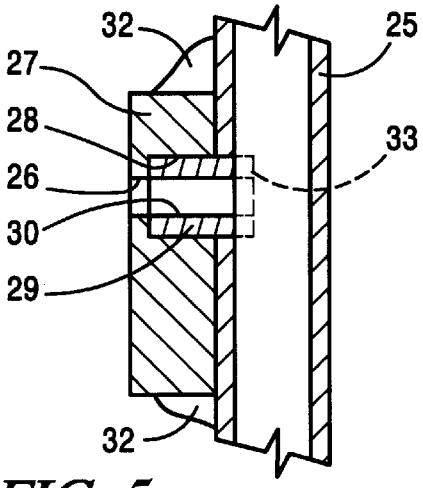
FIG. 5 is a sectional view, similar to FIG. 4, illustrating an outlet opening in a shunt tube having an insert installed therein in accordance with the present invention.

In accordance with the present invention, insert means are provided in the outlet openings 26 in the shunt tubes 25 to alleviate erosion of the outlets. Preferably, the inserts are installed as best shown in FIGS. 3–5. As seen therein, a recess 28 (e.g. 1/4 inch diameter) is countersunk approximately three-fourths of the way (e.g. 3/16 inch) through a short length of plate 27 (e.g. 1/4 inch, steel stock) which, in turn, has substantially the same width as shunt tube 25 so that plate 27 conforms to and easily fits thereon.

An insert 29 of erosion-resistant material (e.g. tungsten carbide) having a passage 30 extending therethrough is positioned into recess 28. Insert 29 has an outer dimension (e.g. outer diameter) which is approximately the same (i.e. slightly smaller) as the dimensions of the perimeter of recess 28 (e.g. inner diameter) whereby insert 29 can be pressed and/or "sweated" into the recess and held therein. While insert 29 and matching recess 28 are illustrated as being cylindrical, it should be recognized that these elements can also have different matching configurations, e.g. square, triangular, etc., without departing from the present invention.

The length of insert 29 (e.g. 7/16 inch) is such that it will extend outward from recess 28 for a distance at least equal to the wall thickness of shunt tube 25 (e.g. 1/4 inch) for a purpose described below. In some instances, it may be desirable to make insert 29 even longer so that it will extend a short distance into the shunt tube when in its operable position.

Outlet passage 26, which is concentric with recess 28, is drilled or otherwise provided in plate 27 and is adapted to be aligned with passage 30 when insert 29 is in recess 28. Outlet 26 can be drilled in plate 27 before the insert is positioned in the recess or it can be drilled through passage 30 after the insert has been positioned within recess 28.

An opening 31 (FIG. 3) is drilled or otherwise provided in shunt tube 25 at each location where an outlet is desired. With insert 29 within recess 28, plate 17 is positioned on tube 25 so that the extension of insert 28 is tightly positioned within its respective opening 31 in shunt tube 25. Plate 27 is then secured to shunt tube by any appropriate means, e.g. spot welding 32, etc. The extension of insert 28 may terminate flush with the inside of the wall of tube 25 or may extend into the tube as shown by dotted lines 33, FIG. 5.

Figure 6:
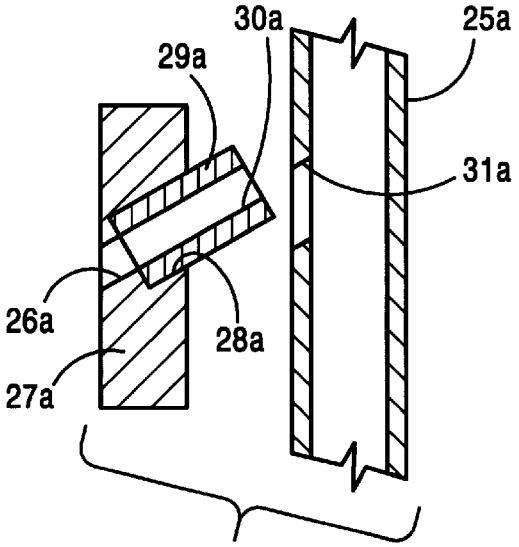
FIG. 6 is a partial sectional view of a shunt tube of the tool of FIG. 1 illustrating a step of installing an inclined insert within an outlet opening thereof in accordance with a further embodiment of the present invention.
Figure 7:
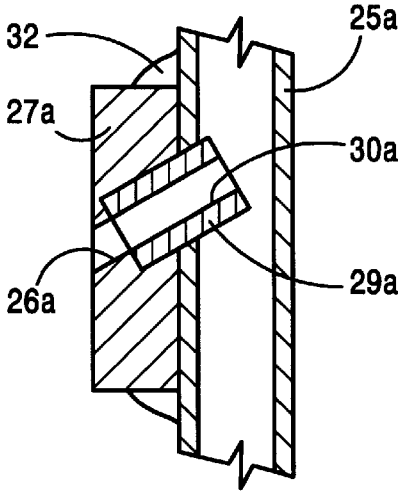
FIG. 7 is a sectional view, similar to FIG. 6, illustrating the insert installed within an outlet opening in the shunt tube.

FIGS. 6 and 7 disclose an embodiment of the present invention which is basically similar to that described above except insert **29*a* is positioned within recess 28*a* which has been countersunk at a downward angle in plate 27*a*. Opening 31*a* in shunt tube 25*a* is also inclined at the same angle as recess 28*a* so that the extension of insert 29*a* will fit snuggly in opening 31*a* when plate 27*a* is in its operable position on shunt tube 25*a*. The extension 33*a* of insert 29 will extend into shunt 25*a* and thereby present a downward inclined, outlet passage 30*a*, 26*a* for fluids flowing downward through shunt tube 25*a***.

What is claimed is:

1. A well tool for use in a well, said well tool comprising:

a body comprising a well screen;

at least one alternate flowpath extending along said body, said alternate flowpath comprises:

a conduit having a plurality of outlet openings spaced along its length for delivering fluid to different levels within a well when said well tool is in an operable position in said well; and an insert means comprised of an erosion-resistant material in each of said plurality of spaced outlet openings for alleviating erosion of said openings.

2. A method of installing an insert having a passage therethrough in an outlet opening in an alternate flowpath of a well tool, said method comprising:

forming a recess in a plate, said recess extending only partially through said plate and being adapted to receive said insert;

forming an outlet passage in said plate which is in fluid communication with said recess;

positioning said insert in said recess with said passage in said insert being aligned with said outlet passage in said plate;

forming an opening in said alternate flowpath;

positioning said plate on said alternate flowpath with said insert aligned with said opening in said alternate flowpath; and securing said plate to said alternate flowpath.

3. The method of claim 2 wherein said insert extends through said opening in said alternate flowpath and terminates flush with the inside wall thereof.

4. The method of claim 3 wherein the dimensions of the perimeter of said recess is only slightly greater that the dimensions of the outer surface of said insert whereby said insert is pressed and/or sweated therein.

5. The method of claim 2 wherein said insert extends through said opening in said alternate flowpath and into said alternate flowpath.

6. The method of claim 5 wherein said insert extends through said opening in said alternate flowpath and into said alternate flowpath and is incline downwardly at an angle.

7. A well tool for use in a well, said well tool comprising:

a body;

at least one alternate flowpath extending along said body, said alternate flowpath comprises:

a conduit having a plurality of spaced outlet openings therein for delivering fluid to different levels within a well when said well tool is in an operable position in said well; and an insert means in each of said plurality of spaced outlet openings for alleviating erosion of said openings wherein said insert means comprises:

a plate having a recess therein and an outlet passage in fluid communication with said recess;

an insert positioned within said recess and having a passage therethrough aligned with said outlet passage in said plate, said insert having a length sufficient to extend from said recess and into an opening in said conduit; and means for securing said plate to said conduit when said insert is within said opening in said conduit.

8. The well tool of claim 7 wherein said insert is formed of tungsten carbide.

9. The well tool of claim 7 wherein said length of said insert is sufficient to terminate flush with the inside wall of said conduit when said plate is secured to said conduit.

10. The well tool of claim 7 wherein said length of said insert is sufficient to extend through said opening in said conduit and into said conduit when said plate is secured to said conduit.

11. The well tool of claim 7 wherein said recess and said outlet passage is formed at an angle in said plate whereby said insert positioned within said recess is inclined downwardly within said conduit when said plate is secured to said conduit.

* * * * *